United States Patent [19]

Harris et al.

[11] Patent Number: 4,679,624

[45] Date of Patent: Jul. 14, 1987

[54] HYDRAULIC SETTING TOOL

[75] Inventors: Monty E. Harris, Azle; Richard A. Sukup, Burleson, both of Tex.

[73] Assignee: The Western Company of North America, Fort Worth, Tex.

[21] Appl. No.: 774,023

[22] Filed: Sep. 9, 1985

[51] Int. Cl.[4] ..... E21B 23/04

[52] U.S. Cl. ..... 166/120; 166/123; 166/181; 166/386

[58] Field of Search ..... 166/120, 123, 181, 193, 166/383, 386

[56] References Cited

U.S. PATENT DOCUMENTS

| | | | |
|---|---|---|---|
| 2,599,386 | 6/1952 | Haynes | 166/70 |
| 3,125,162 | 3/1964 | Briggs, Jr. et al. | 166/123 |
| 3,237,695 | 3/1966 | Bostock et al. | 166/123 |
| 4,390,065 | 6/1983 | Richardson | 166/181 |
| 4,487,258 | 12/1984 | Jackson et al. | 166/120 |
| 4,512,398 | 4/1985 | Hazel | 166/242 |
| 4,516,634 | 5/1985 | Pitts | 166/120 |

*Primary Examiner*—Stephen J. Novosad
*Assistant Examiner*—William P. Neuder
*Attorney, Agent, or Firm*—Richards, Harris, Medlock & Andrews

[57] ABSTRACT

In an oil or gas well, a cement retainer setting tool for setting and pumping cement therethrough includes an inner piston defining a bore and an activation sleeve carried on the piston and defining an annular space between the piston and sleeve. A sleeve ring is formed inwardly from the activation sleeve and is positioned within the annular space beween the piston and the sleeve. Ports are provided to the piston above the sleeve ring for communicating a retainer setting pressure to the sleeve ring to move the sleeve downwardly relative to the piston upon application of such pressure. A plug means for plugging the lower end of the piston is provided therein. The plug means is disengagable upon application of a predetermined pressure greater than the retainer setting pressure. A second port structure is provided for connecting the lower end of the piston to a cement retainer, or other tool.

32 Claims, 7 Drawing Figures

HYDRAULIC SETTING TOOL

TECHNICAL FIELD

The present invention relates to a hydraulic setting tool for use downhold in oil and gas wells, and more specifically, relates to a hydraulic setting tool which premits setting of retainers and subsequent pumping of fluids through the tool without removal.

BACKGROUND ART

In the completion of oil and gas wells, after drilling to the desired depth, production casing is run into the drilled well bore and is set in place by cementing the annulus between the casing and the well bore. This cementing step is normally accomplished by setting a cement retainer at a desired depth and by pumping cement, at high pressures, below the cement retainer. The retainer prevents the movement of cement into the interior of the casing thereby forcing the cement into the annulus between the casing and the well bore.

The customary procedure for completing such a cementing process includes running the cement retainer into the well, and setting the retainer using either a mechanical or hydraulic setting tool. If the setting procedure is hydraulic, the tool is run into the well on the end of a pipe string, and once set, the cement retainer setting tool is uncoupled from the cement retainer and it, with the pipe string, is removed from the well. The pipe string is then reinserted into the well and cement is pumped therethrough to complete the cementing operation.

Thus, the process of setting the cement retainer, when set hydraulically, requires that the pipe string be run into the well, then backed out, and then rerun to complete the cementing operation. Such procedure takes substantial time and manpower, with the investment being multiplied as the depth of the well increases. Thus, tools and procedures for eliminating the time and manpower needed to complete the cementing process represent a substantial advancement in the art.

Once set, the cement retainer is removed by drilling through it. Thus, it is critical that a cement retainer setting tool not permit premature setting as is possible in many current designs. The tool must also provide for ease in setting the tool at the desired time. Further, the sequence of steps which must be accomplished by the operator in setting the tool must be straight forward and not require any interpretation of downhold pressure or sequences, which may be difficult or impossible to ascertain by the operator.

Retainer setting tools are normally reused many times. Prior to such reuse, however, the tools must be disassembled and shear pins and other components redressed. In some current retainer setting tools, fluids under high pressures may be trapped within the tool when down hole. When such tools are redressed, these pressurized fluids will be released resulting in the possibility of injury. Thus, the simplicity and safety with which the tool can be redressed is of significant importance.

DISCLOSURE OF THE INVENTION

The present invention provides a hydraulic retainer setting tool which also permits conducting the fluid injection operation, such as cementing, without removal of the setting tool. In one embodiment of the invention, the tool includes an inner piston defining a bore therein and structure carried on the inner piston responsive to a first pressure to the interior of the bore for moving an actuation means into engagement with the retainer for setting the retainer.

A second structure carried within the inner piston is responsive to a second pressure greater than that of the first pressure, for opening a passageway through the inner piston subsequent to setting of the retainer to permit flow through the tool.

In a further embodiment of the invention, a cement retainer setting tool for setting and pumping cement therethrough includes an inner piston defining a bore and an activation sleeve carried on the piston and defining an annular space between the piston and the sleeve. A sleeve ring is formed inwardly from the activation sleeve and is positioned within the annular space between the piston and the sleeve. Ports are provided in the piston above the sleeve ring for communicating a retainer setting pressure to the sleeve ring to move the sleeve downwardly relative to the piston upon application of such pressure.

A plug means for plugging the lower end of the piston is provided therein. The plug means is disengagable upon application of a predetermined pressure greater than the retainer setting pressure. A second port structure is provided for connecting the lower end of the piston to a cement retainer, or other tool.

In accordance with a further embodiment of the invention, the tool further comprises structure for securing the plug means in its disengaged position, such disengaged position being out of the flow path of fluid through the second port means. The activation sleeve further comprises an upper sleeve and a lower sleeve connected by shear release pins therein. The shear pins have a shear release limit less than that required to disengage the plug means.

Further, the second port means has an area at least equal to that of the inner piston bore to provide unchoked flow through the tool.

In accordance with a further embodiment of the invention, the activation sleeve has a pair of piston rings formed inwardly therefrom and positioned within the annular space between the piston and the sleeve. The piston has ports above each of the piston rings for communicating pressure on the sleeve to move the sleeve downwardly relative to the piston upon application of pressure within the inner piston bore. In this way, a double piston effect is created to provide high setting forces at relative low tool activation pressures.

The disengagable plug means includes a seat assembly having a substantially cylindrical body with a bore therethrough. The bore defines an annular tapered seat at the upper end thereof and locking fingers at the lower end. The seat assembly is designed to sealingly receive a dart assembly having a spherical head, a stem extending from the head, with the stem having a reduced annular portion at the lower end thereof defining a step. The locking fingers are designed to engage the reduced annular portion of the dart assembly for engagement with the step when the head of the dart assembly is seated in the tapered seat.

Subsequent to setting the cement retainer using the tool of the present invention, a higher pressure is applied to the tool inner bore and the disengagable plug, held by a shear ring, is released and moved for engagement within a plug securing structure. This structure is defined in the lower end of the inner piston and has a bore therein and expandable fingers for receiving the disengagable plug therein. The fingers of the securing structure serve to lock the plug means within the bore.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figures 1A, 1B:
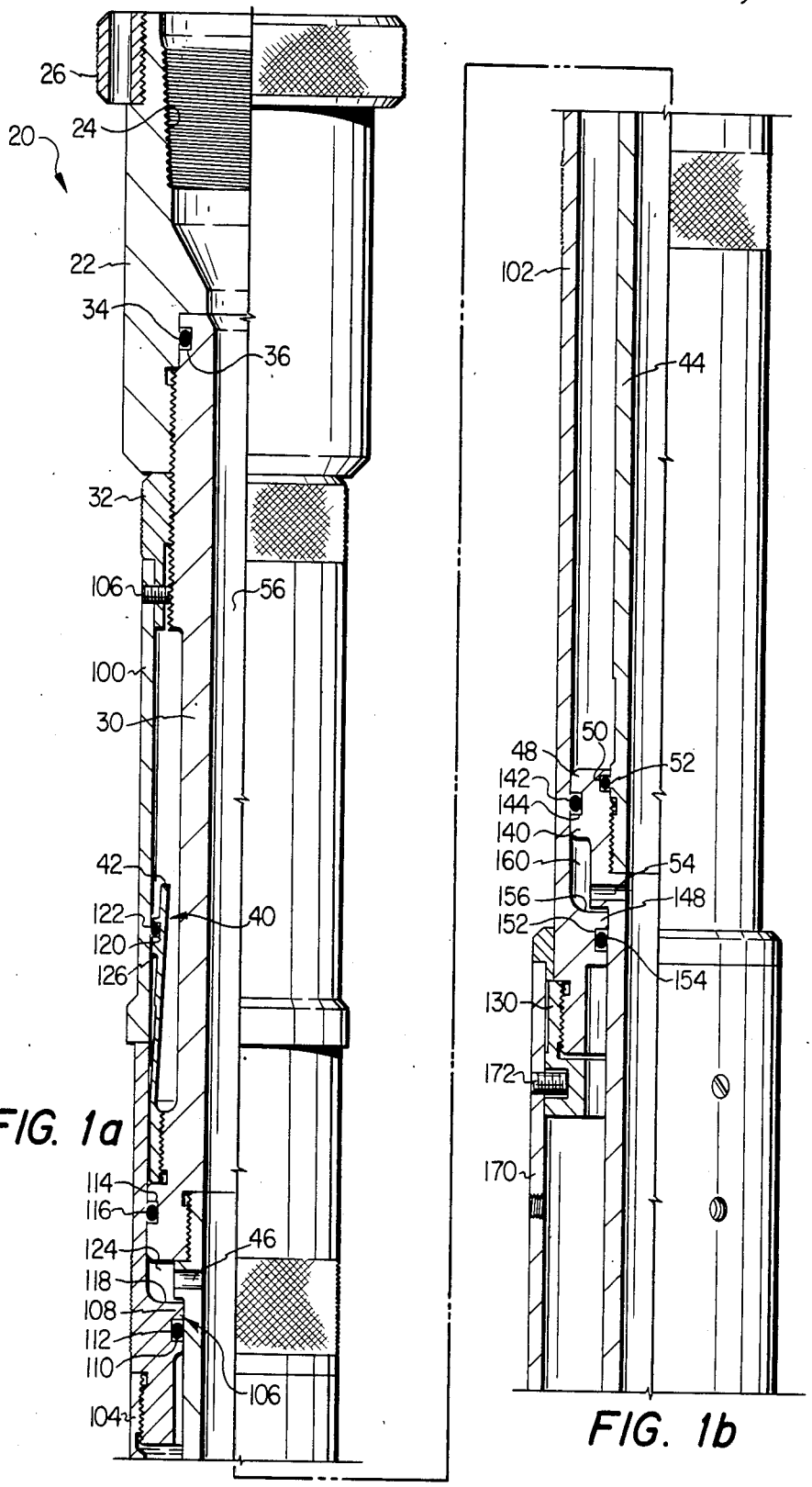
FIGS. 1*a*, 1*b*, 1*c* and 1*d* are a quarter section view of the tool of the present invention.

FIGS. 1*a* through 1*d* show the hydraulic setting and tool assembly 20 of the present invention in quarter section. Tool 20 includes a top sub 22 defining a threaded box 24 for attachment to a pipe string (not shown). A collar 26 is threadedly received on the upper end of top sub 22. The lower end of sub 22 is threaded to receive the upper threaded end of upper piston 30. An adjuster sub 32 is also threadedly received on the upper piston 30 below top sub 22. The upper end of upper piston 30 has an annular groove 36 for receiving an O-ring 34 therein. O-ring 34 forms a fluid tight seal between upper piston 30 and top sub 22.

The lower end of upper piston 30 is threaded to receive a locking collet 40. Collet 40 has a plurality of fingers 42 for cooperation with the tool setting mechanism, to be discussed hereinafter in greater detail.

The lower end of upper piston 30 is internally threaded to receive tubular piston rod 44. As can be seen in FIG. 1*a*, a plurality of ports 46 are formed through piston rod 44 immediately below the connection of upper piston 30 and piston rod 44.

The lower end of piston rod 44 is externally threaded to receive lower piston 48 thereon. Lower piston 48 has an annular groove 50 for receiving an O-ring 52 for forming a fluid tight seal between piston rod 44 and lower piston 48. A plurality of ports 54 are formed through lower piston 48 immediately below the connection of piston rod 44 to lower piston 48 (FIG. 1*b*). An open bore 56 is defined within the tool by piston 32, piston rod 44 and lower piston 48.

Figure 1C:
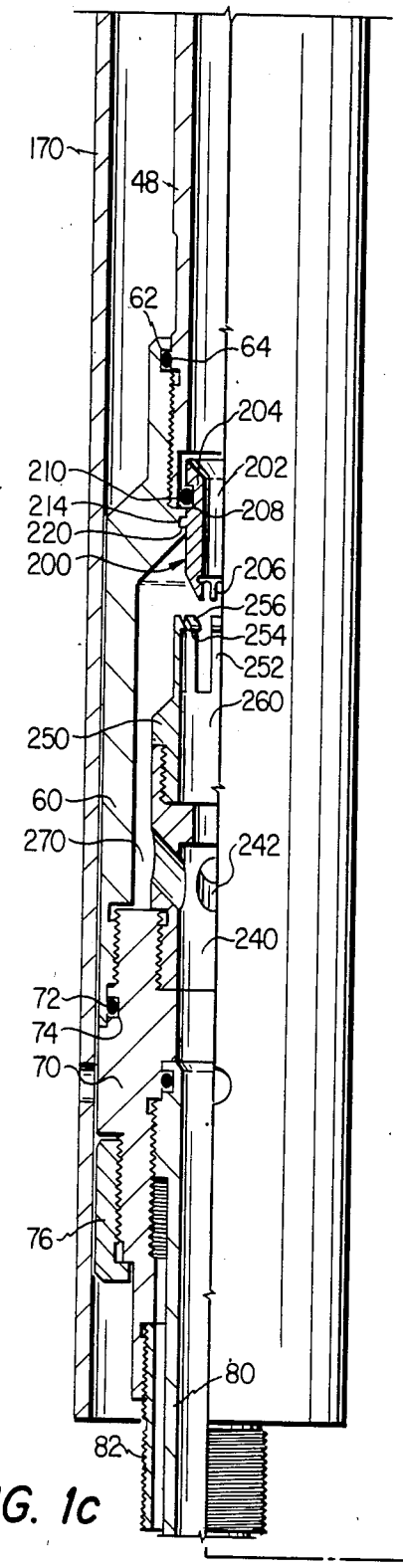
Figure 1D:
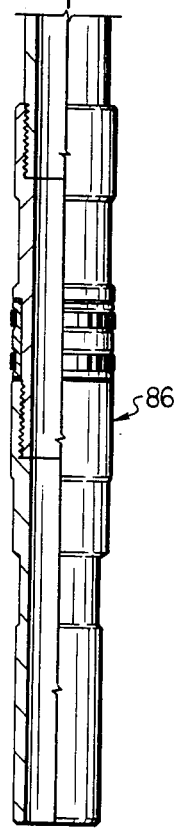

As can be seen in FIG. 1*c*, the lower end of lower piston 48 is externally threaded to receive a ball set housing 60 thereon. Ball set housing 60 has an annular groove 62 for receiving O-ring 64 to form a fluid tight seal between ball set housing 60 and lower piston 48. The lower end of ball set housing 60 is internally threaded to receive stinger assembly 70. O-ring 72 is positioned in an annular groove 74 for forming a seal between ball set housing 60 and stinger assembly 70. A collar 76 is positioned on external threads at the lower end of stinger assembly 70, and a setting tool coupling sleeve 80 is connected by way of internal threads from stinger assembly 70. A further threaded coupling sleeve 82 is attached from the lower end of stinger assembly 70.

A retainer stinger 86 is attached to the lower end of coupling sleeve 82.

Referring again to FIG. 1*a*, an upper cylinder 100 and lower cylinder 102, joined at thread connection 104, are carried around upper piston 30 and piston rod 44. Referring to FIG. 1*a* and 1*b* the upper end of upper cylinder 100 is attached to adjustment sub 32 by shear screws 106. Upper cylinder 100 has a circumferential landing 108 near its bottom end with an annular groove 110 therein for receiving an O-ring 112. O-ring 112 engages piston rod 44 and forms a sealing engagement therewith. Upper piston 30 has an annular groove 114 for receiving an O-ring 116 therein. O-ring 116 engages the inner wall of upper cylinder 100 forming a seal therearainst. As can be seen in FIG. 1*a*, the seal formed by O-ring 116 is above port 46 and the seal formed by O-ring 112 is below port 46.

The lower end of upper cylinder 100 has an annular sleeve formed interiorly thereof to define a landing 108 having an annular groove 110 for receiving O-ring 112. An upwardly directed piston surface is defined by landing 108. A chamber 124 is defined between upper piston 30 and the lower end of upper cylinder 100 (FIG. 1*a*) and is in communication with the interior bore of the tool by way of port 46.

Referring still to FIG. 1*a*, collet fingers 42 are defined with an annular groove 120 with an O-ring 122 therein. O-ring 122 engages the inner wall of upper cylinder 100 to form a seal therewith. A step 126 is provided just below the annular landing on which O-ring 122 is positioned. In the position shown in FIG. 1*a*, collet fingers 42 are flexed inwardly by upper cylinder 100.

The upper end of lower piston 48 has an annular landing 140 with an annular groove 142 for receiving an O-ring 144 therein. O-ring 144 is in sealing contact with the inside wall of lower cylinder 102. The lower end of lower cylinder 102 is formed with an annular landing 150 having an annular groove 152 for receiving an O-ring 154 therein. O-ring 154 is in sealing engagement with the outer surface of lower piston 48. Referring to FIG. 1*b*, it can be seen that O-ring 144 provides a seal above port 54 and O-ring 154 provides a seal therebelow.

An annular sleeve 148 is formed interiorly at the lower end of lower cylinder 102. Sleeve 148 defines a annular landing 150 having an annular groove 152 formed therein for receiving an O-ring 154. Annular sleeve 148 defines an upwardly facing piston surface 156.

Referring now to FIG. 1*b*, a setting sleeve collar 130 is threadedly engaged on the lower end of lower cylinder 102. A setting sleeve 170 is attached at its upper end to lower cylinder 102 by shear screws 172 engaged through setting sleeve 170 and received in setting sleeve collar 130.

Further, a chamber 160 is formed between annular ring 158 opened to the interior of the tool central bore by port 54.

Referring to FIG. 1*c*, the lower end of setting sleeve 170 is received around ball set housing 60, stinger assembly 70 and collar 76. A dart seat assembly 200 is mounted at the lower end of lower piston 48 and within ball set housing 60. Seat assembly 200 includes a cylindrical body 202 defining at its upper end an annular tapered seat 204. The lower end of a plurality of fingers 206 are formed at the lower end of body 202.

An annular groove 208 is formed exteriorly of body 202 for receiving an O-ring 210 therein. A shear ring 214 is formed below annular groove 208 and extending from the exterior of body 202. As can be seen in FIG. 1c O-ring 210 is in engagement with the interior wall of lower piston 48. Further, in assembly, the lower end of lower piston 48 engages the upwardly facing surface of shear ring 214. Shear ring 214 is seated on a upwardly facing step 220 formed in ball set housing 60.

Thus, as can be seen in FIG. 1c, dart seat assembly 200 is held in position between ball set housing 60 and lower piston 48. The seat assembly is prevented from normally moving downwardly relative to ball set housing 60 by engagement of shear ring 214 with step 220 on ball set housing 60.

A port assembly 240 is threadedly received and supported from the top end of stinger assembly 70. Port assembly 240 has a plurality of ports 242 extending through the side walls in an angular relationship as shown. A seat assembly retainer 250 is threadedly received and supported at the top end of port assembly 240. The seat assembly retainer has a plurality of fingers 252 extending upwardly therefrom, each finger having a hooked end 254 with a downwardly tapered upwardly facing surface 256. Seat assembly retainer 250 has an inner bore 260 for receiving dart seat assembly 200.

Ports 242 have a combined area equal to or greater than that of the open bore 56 of the tool. Further, an annular space 270 is defined between ball set housing 60 and seat assembly retainer 250 and port assembly 240. This annular space has an area equal to or greater than that of the open bore 56 of the tool.

Figure 2A:
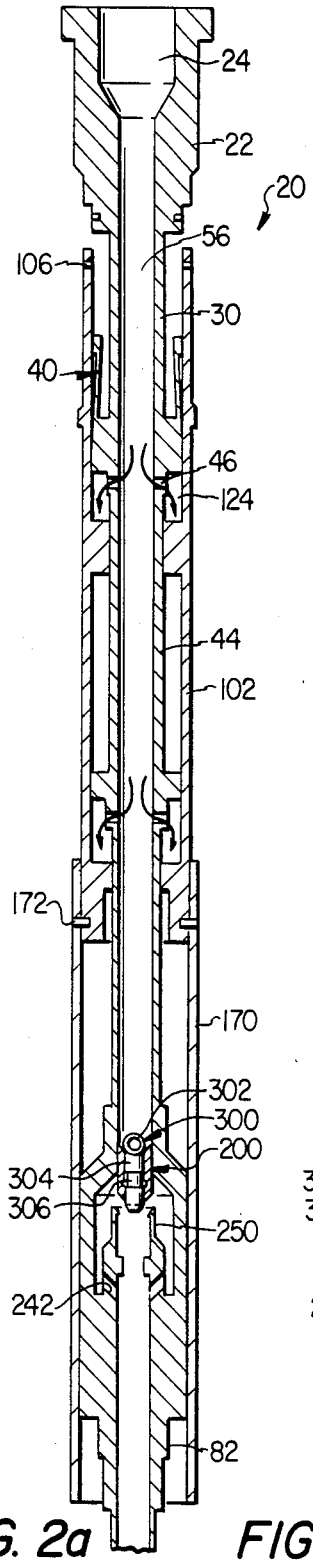
FIG. 2*a* is a section view showing the tool in the setting phase.
Figure 2B:
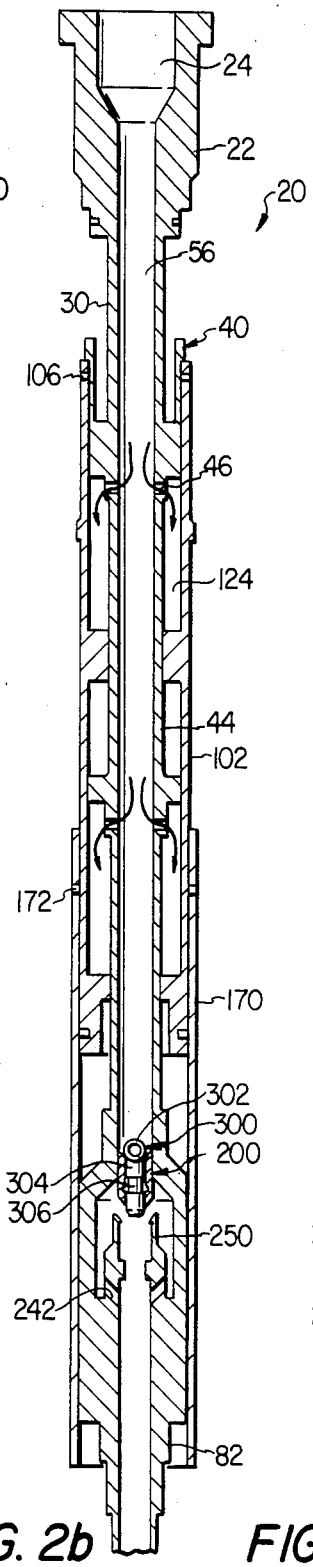
FIG. 2*b* is a section view of the tool in the post-setting position with the lower sleeve in the sheared and released position.
Figure 2C:
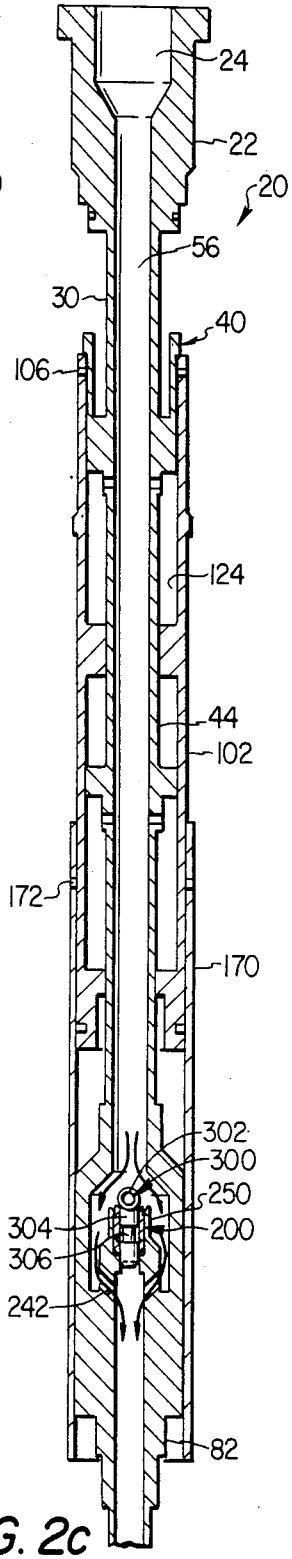
FIG. 2*c* is a section view of the tool with the bottom plug disengaged, permitting cementing or other flow operations to be conducted through the tool.

FIGS. 2a through 2c illustrate the operation of the present invention. Although not shown in the drawings, it will be understood by those skilled in the art that tool 20 is supported on the end of a drill string, with the string engaging the tool at threads 24 of top sub 22. Further, in the primary embodiment of the invention, the tool is used in conjunction with a cement retainer which is attached at the lower end on coupling sleeve 82.

In the first sequence of operation, tool 20 is lowered into the well on the end of a pipe string until the cement retainer attached to the lower end of the tool is at the desired depth. A dart assembly 300 is dropped into the pipe string and permitted to gravitate downwardly into the tool where it is seated in dart seat assembly 200. Referring to FIG. 2a, it can be seen that dart assembly 300 incluues a spherical head 302 with a shaft 304 extending therefrom. A reduced diameter section 306 is defined on shaft 304 as shown. With dart assembly 302 in position within seat assembly 200, the tool is pressured up, by applied pressure to the open bore by way of the drill string.

With dart assembly seated in dart seat assembly 200, pressure is communicated through ports 46 and 54 into chambers 124 and 160, respectfully. Fluid pressure is applied to annular piston surfaces 118 and 156, respectfully, and shear screw 106 is sheared. As a result, upper cylinder 100 and lower cylinder 102 are moved downwardly as shown in FIG. 2a. This movement of the upper and lower cylinders actuates the cement retainer in the usual manner.

Although a sufficient setting force is reached, a higher pressure is introduced into the tool resulting in the shearing of shear screw 72, thereby permitting setting sleeve 170 to slide freely upwardly, or to float relative to upper and lower cylinders 100 and 102, respectfully. Upper and lower cylinders 100 and 102 continue to move downwardly until they are locked in place by collet fingers 42 on locking collet 40. As can been seen in FIG. 2b, upper cylinder 100 moves downwardly until the uppermost edge travels below step 126 of locking collet 40. Locking collet 40 moves outwardly under its own bias construction and prevents the upward movement of upper cylinder 100.

At this stage, additional pressure is applied resulting in the shearing of shear ring 214 on dart seat assembly 200 forcing the seat assembly into engagement with seat assembly retainer 250. The movement of dart seat assembly 200 into the assembly retainer is with substantial force, causing the seat assembly to flex fingers 252 of retainer of seat assembly retainer 250 such that the seat assembly is received within the retainer with the upper edge positioned below hooked ends 254. It will be appreciated that tapered surfaces 256 facilitates the movement of the seat assembly 200 into retainer 250 and the hooked ends 254 prevent withdrawal. Further, the seat assembly 200 moves with such impact into the retainer 250 such that fingers 206 of the seat assembly are bent inwardly into engagement with the reduced diameter portion of the dart assembly, thereby preventing the movement of the dart assembly out of its seated position.

It will be appreciated that at this stage of operation, seat assembly 200 has moved out of the throat of ball set housing 60 to open a port connecting the bore of the tool with ports 242 in port assembly 240 (FIG. 2c). The flow channel through this port and around ball set housing 60 by way of annular space 270 provides for an unrestricted flow through the tool. Thus, without removing the setting tool, cement or other fluids, as desired, may be injected through tool 20 for flow below the setting tool. Thus, the tool of the present invention provides for the hydraulic setting of the retainer followed by the injection of cement or other fluid through the tool without requiring the drill pipe to be removed for purposes of removing the setting tool.

It will also be appreciated from the design illustrated and described that the present tool provides for high setting forces at low applying pressures. The use of the double piston arrangement described provides for a multiplication of forces. Thus, required tool setting forces can be achieved with relatively small tool bore pressure. Further, the tool of the present invention provides for locking the upper portion of the activation sleeve in place, while permitting the lower sleeve to be sheared and to move freely out of interference with the retainer subsequent to setting. By locking the upper activation cylinder in place, the tool prevents the entrapment of high pressures within the tool. Thus, when the tool is removed, subsequent to cementing, and during the redressing operation, no high pressure fluid or gas is entrapped in any cavity defined by the tool. This is to be distinguished from prior art hydraulic setting tools where high pressures may be entrapped within the tool and subsequently discharged during the redressing operation.

In the present invention, it can be seen that chamber 124 (FIG. 1a), positioned between the lower end of upper piston 30 and piston surfacae 118 of upper cylinder 100, and chamber 160 (FIG. 1b), positioned between the upper end of lower piston 48 and piston surface 156 of lower cylinder 102, are open to the inner bore 56, and thus are ventilated to atmospheric pressure upon removal of the tool. The tool does not include other chambers which could become, and remain, pressurized during operation. The lock-out feature provided by locking collet 40 retains the upper cylinder 100 in its extended and locked position and prevents the entrapment of high pressure in any cavities defined by the tool.

Further, the present design provides for the unrestricted flow of fluids, including cement, therethrough. The operation of the tool is also straight forward whereby the operator merely follows a sequence of increasing pressure to the bore, to first set the retainer and then to disengage the dart and dart seat assembly. The tool further provides for securing both the dart assembly and seat assembly in a retainer which prevents the interference by these structures with fluid flow through the tool.

It will also be appreciated that the tool is versatile in use in that it may be used with shear type or rotational release cement or other retainers. The only modification needed to accommodate these varying retainers is minor modification to the retainer coupling structure provided on the tool.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications, and substitutions of parts and elements as fall within the scope of the invention.

We claim:

1. An oil or gas well retainer setting and fluid pumping tool comprising:

means responsive to a first pressure to the interior bore of the tool for moving an actuation means into engagement with the retainer for setting said retainer;

means responsive to a second pressure in the bore of the tool for disengaging a plug means in the tool to open a passageway in said too to permit fluid flow through said tool, and means within the tool for capturing said plug means in its disengaged position wherein said means for capturing said plug means comprises a fitting having a bore therein and expandable fingers receiving said disengageable plug means therein, said fingers serving to lock said plug means in said fitting when engaged therein.

2. The tool according to claim 1 wherein said second pressure is higher than that of said first pressure.

3. The tool according to claim 1 wherein said actuation means is a sleeve having an effective piston surface against which said first pressure is applied to move said sleeve against said retainer.

4. A cement retainer setting and cement pumping tool comprising:

an inner piston defining a bore therein;

activation means carried on said inner piston responsive to a first pressure to the interior of said bore for moving said activation means into engagement with the cement retainer for setting said retainer;

release means associated with said activation means and responsive to a second pressure greater than said first pressure for releasing said activation means from engagement with the cement retainer; and means responsive to a third pressure, greater than said second pressure. within said bore for opening a passageway through said inner piston to permit flow through the tool.

5. The tool according to claim 4 wherein said effective piston surface comprises dual annular rings formed on the interior wall of said sleeve and positioned in an annulus between sleeve and piston; and wherein said first pressure is communicated above said annular rings through ports in said inner piston communicating said pressure above said rings.

6. In an oil or gas well, retainer setting tool for setting and pumping fluid therethrough comprising:

an inner piston defining a bore therein;

an activation sleeve carried on said piston and defining an annular space between said piston and sleeve;

a sleeve ring formed inwardly from said sleeve and positioned within the annular spaced between said piston and said sleeve;

ports in said piston above said sleeve ring for communicating a retainer setting pressure on said sleeve ring to move said sleeve downwardly relative to said piston upon application of pressure;

plug means for plugging the lower end of said piston, said plug means being disengagable upon application of pressure greater than said retainer setting pressure;

means for securing said plug means in its disengaged position, said disengaged position being out of the flow path of fluid through said second port means; and second port means communicating the lower end of the bore of said piston to tools attached thereto.

7. The tool according to claim 6 wherein said actuation sleeve comprises an upper sleeve and a lower sleeve connected by shear release means.

8. The tool according to claim 7 wherein said shear release means has a shear failure limit less than that required to disengage said plug means.

9. The tool according to claim 6 wherein said second port means has an area at least equal to that of the inner piston bore.

10. The tool according to claim 6 wherein said actuation sleeve has a pair of piston rings formed inwardly therefrom and positioned within the annular space between said piston and sleeve and wherein said piston has ports above each said ring for communicating pressure on said sleeve to move said sleeve downwardly relative to said piston upon application of pressure within said inner piston bore.

11. The tool according to claim 6 wherein said disengagable plug means comprises:

a seat assembly having a substantially cylindrical body with a bore therethrough, said bore defining an annular tapered seat at the upper end and locking fingers at the lower end, said seat assembly designed to sealingly receive a dart assembly having a substantially spherical head, a stem extending from the head, said stem having a reduced annular portion at the lower end thereof defining a step, said locking fingers engaging said reduced annular portion and engaging said step when the head of said dart assembly is seated in said tapered seat.

12. The tool according to claim 6 wherein said plug securing means comprises a fitting having a bore therein and expandable fingers for receiving said disengagable plug means therein, said fingers serving to lock said plug means in said fitting when engaged therein.

13. In an oil or gas well, a retainer setting tool for setting and pumping fluid therethrough comprising:

an inner piston defining a bore therein;

an activation sleeve carried on said piston and defining an annular space between said piston and sleeve;

means for moving said sleeve relative to said piston and into engagement with the retainer upon application of a retainer setting pressure to the bore in the piston;

plug means for plugging the lower end of said piston, said plug means being releasable upon application of pressure greater than said retainer setting pressure;

means for securing said plug means in its disengaged position, said disengaged position being out of the flow path of fluid through said second port means; and second port means communicating the lower end of the bore of said piston to tools attached hereto.

14. The tool according to claim 13 wherein said actuation sleeve comprises an upper sleeve and a lower sleeve connected by a shear release means.

15. The tool according to claim 14 wherein said shear release has a shear failure limit less than that required to disengage said plug means.

16. The tool according to claim 13 wherein said second port means has an area at least equal to that of the inner piston bore.

17. The tool according to claim 13 wherein said actuation sleeve has a pair of piston rings formed inwardly therefrom and positioned within the annular space between said piston, and sleeve and wherein said piston has ports above each said ring for communicating pressure on said sleeve to move said sleeve downwardly relative to said piston upon application of the pressure within said inner piston bore.

18. The tool according to claim 13 wherein said releasable plug means comprises:

a seat assembly having a substantially cylindrical body with a bore therethrough, said bore defining an annular tapered seat at the upper end and locking fingers at the lower end, said seat assembly designed to sealingly receive a dart assembly having a substantially spherical head, a stem extending from the head, said stem having a reduced annular portion at the lower end thereof defining a step, said locking fingers engagin said reduced annular portion and engaging said step when the head of said dart assembly is seated in said tapered seat.

19. The tool according to claim 13 wherein said plug securing means comprises a fitting having a bore therein and expandable fingers for receiving said disengageable plug means therein, said finger serving to lock said plug means in said fitting when engaged therein.

20. In an oil or gas well, retainer setting tool for setting and pumping fluid therethrough comprising:

an inner piston defining a bore;

an activation sleeve carried on said piston and defining an annular space between said piston and sleeve, said actuation sleeve comprising an upper sleeve and a lower sleeve connected by shear release means;

a sleeve ring formed inwardly from said sleeve and positioned within the annular space between said piston and said sleeve;

ports in said piston above said sleeve ring for communicating a retainer setting pressure on said sleeve ring to move said sleeve downwardly relative to said piston upon application of pressure;

plug means for plugging the lower end of said piston, said plug means being disengagable upon application of pressure greater than said retainer setting pressure;

said shear release means having a shear failure limit less than that required to disengage said plug means such that said shear release means connecting the upper and lower sleeves of the actuation sleeve is sheared prior to said plug means being disengaged upon application of increased pressure on said sleeve ring;

second port means communication the lower end of the bore of said piston to tools attached thereto.

21. The tool according to claim 20 further comprising:

means for securing said plug means in its disengaged position, said disengaged position being out of the flow path of fluid through said second port means.

22. The tool according to claim 20 wherein said second port means has an area at least equal to that of the inner piston bore.

23. The tool according to claim 20 wherein said actuation sleeve has a pair of piston rings formed inwardly therefrom and positioned within the annular space between said piston and sleeve and wherein said piston has ports above each said ring for communicating pressure on said sleeve to move said sleeve downwardly relative to said piston upon application of pressure within said inner piston bore.

24. The tool according to claim 20 wherein said disengagable plug means comprises:

a seat assembly having a substantially cylindrical body with a bore therethrough, said bore defining an annular tapered seat at the upper end and locking fingers at the lower end, said seat assembly designed to sealingly receive a dart assembly having a substantially spherical head, a stem extending from the head, said stem having a reduced annular portion at the lower end thereof defining a step, said locking fingers engaging said reduced annular portion and engaging said step when the head of said dart assembly is seated in said tapered seat.

25. The tool according to claim 21 wherein said plug securing means comprises means comprises a fitting having a bore therein and expandable fingers for receiving said disengagable plug means therein, said fingers serving to lock said plug means in said fitting when engaged therein.

26. In an oil or gas well, a retainer setting tool for setting and pumping fluid therethrough comprising:

an inner piston defining a bore therein;

an activation sleeve carried on said piston and defining an annular space between said piston and sleeve, said actuation sleeve comprising an upper sleeve and a lower sleeve connected by a shear release means;

means for moving said sleeve relative to said piston and into engagement with the retainer upon application of a retainer setting pressure to the bore in the piston;

plug means for plugging the lower end of said piston, said plug means being releasable upon application of pressure greater than said retainer setting pressure;

said shear release means having a shear failure limit less than that required to disengage said plug means such that said shear release means connecting the upper and lower sleeves of the actuation sleeve is sheared upon application of increased pressure to said piston prior to said plug means being disengaged; and second port means communicating the lower end of said piston to tools attached hereto.

27. The tool according to claim 26 further comprising:

means for securing said plug means in its disengaged position, said disengaged position being out of the flow path of fluid through said second port means.

28. The tool according to claim 26 wherein said second port means has an area at least equal to that of the inner piston bore.

29. The tool according to claim 26 wherein said actuation sleeve has a pair of piston rings formed inwardly therefrom and positioned within the annular space between said piston and sleeve and wherein said piston has ports above each said ring for communicating pressure on said sleeve to move said sleeve downwardly relative to said piston upon application of the pressure within said inner piston bore.

30. The tool according to claim 26 wherein said releasable plug means comprises:

a seat assembly having a substantially cylindrical body with a bore therethrough, said bore defining an aunnular tapered seat at the upper end and locking fingers at the lower end, said seat assembly designed to sealingly receive a dart assembly having a substantially spherical head, a stem extending from the head, said stem having a reduced annular portion at the lower end thereof defining a step, said locking fingers engagin said reduced annular portion and engaging said step when the head of said dart assembly is seated in said tapered seat.

31. The tool according to claim 27 wherein said plug securing means comprises a fitting having a bore therein and expandable fingers for receiving said disengagable plug means therein, said fingers serving to lock said plug means in said fitting when engaged therein.

32. An oil or gas well retainer setting and fluid pumping tool comprising:

means responsive to a first pressure to the interior bore of the tool for moving an actuation means into engagement with the retainer for setting said retainer, said actuation means comprising a sleeve having an effective piston surface against which said first pressure is applied to move said sleeve against said retainer, said effective piston surface comprising dual annual rings formed on the interior wall of said sleeve and wherein said sleeve is carried on a piston, said rings being positioned in an annulus between the sleeve and piston;

means responsive to a second pressure in the bore of the tool for disengaging a plug means in the tool to open a passageway in said tool to permit fluid flow through said tool, and means within the tool for capturing said plug means in its disengaged position.

* * * * *